US006532671B1

(12) United States Patent
Jong

(10) Patent No.: US 6,532,671 B1
(45) Date of Patent: Mar. 18, 2003

(54) TENSION ADJUSTMENT DEVICE FOR A CHAIN SAW

(75) Inventor: Jung-Chang Jong, Chungli (TW)

(73) Assignee: Jenn Feng Industrial Co., Ltd., Ping-Chang (TW)

( * ) Notice: Subject to any disclaimer, the term of this patent is extended or adjusted under 35 U.S.C. 154(b) by 0 days.

(21) Appl. No.: 09/994,691

(22) Filed: Nov. 28, 2001

(51) Int. Cl.[7] ..... B27B 17/14
(52) U.S. Cl. ..... 30/386
(58) Field of Search ..... 30/385, 386; 83/816

(56) References Cited

U.S. PATENT DOCUMENTS 4,129,943 A * 12/1978 Bricker ..... 30/386
5,491,899 A 2/1996 Schlimann et al.
5,983,508 A 11/1999 Sundstrom
2002/0124421 A1 * 9/2002 Hermes et al. ..... 30/386

FOREIGN PATENT DOCUMENTS

CH 294418 * 1/1954 ..... 30/386

* cited by examiner

*Primary Examiner*—Kenneth E. Peterson
(74) *Attorney, Agent, or Firm*—Bacon & Thomas, PLLC

(57) ABSTRACT

An adjusting device has a driving disk with two diametrically oppositely formed arcuate tracks formed thereon and a driven plate securely connected to the chain saw and having multiple bosses evenly and horizontally distributed on the driven plate. The two arcuate tracks are alternately received between two adjacent bosses such that when the driving disk rotates, the driven plate is moved linearly, which results in the adjustment of the tension of the chain saw.

4 Claims, 6 Drawing Sheets

211

TENSION ADJUSTMENT DEVICE FOR A CHAIN SAW

FIELD OF THE INVENTION

The present invention relates to a tension adjustment device, and more particularly to a tension adjustment device for a chain saw. The tension adjustment device has a driving disk with two diametrically oppositely formed arcuate tracks formed thereon and a driven plate securely connected to the chain saw and having multiple bosses evenly and horizontally distributed on the driven plate. The two arcuate tracks are alternately received between two adjacent bosses such that when the driving disk rotates, the driven plate is moved linearly, which results in the adjustment of the tension of the chain saw.

BACKGROUND OF THE INVENTION

With reference to FIG. 5, a conventional tension adjustment device for a chain saw as disclosed in U.S. Pat. No. 5,491,889 has an adjusting ring A, a dust-proof cap B with a hole B2 and a projection B3, a driving disk C with a central hole C1 and an arcuate channel C2, a driven plate E with a boss E1 received in the arcuate channel C2 and two positioning bosses E2, a guide F with two positioning holes F2 corresponding to the two positioning bosses E2 and a cutout F3 and a base G with a threaded bolt G2 and a guide pole G3 both received in the cutout F3. When the adjusting ring A rotates, the driving disk C rotates simultaneously with the adjusting ring A. Because the boss E1 is received in the arcuate channel C2, the driven plate E is moved as well as the guide F, which leads to the adjustment to the tension of the chain saw (not shown).

The adjustment to the tension of the chain saw is based on the engagement between the boss E1 and the arcuate channel C2. Therefore, when an adjustment is required, the shear is focus on the boss E1 and thus the boss E1 is easily worn and damaged.

To overcome the shortcomings, the present invention intends to provide an improved tension adjusting device to mitigate or obviate the aforementioned problems.

SUMMARY OF THE INVENTION

The primary objective of the invention is to provide an improved tension adjusting device having a driving disk with two diametrically oppositely formed arcuate tracks formed thereon and a driven plate securely connected to the chain saw and having multiple bosses evenly and horizontally distributed on the driven plate. The two arcuate tracks are alternately received between two adjacent bosses such that when the driving disk rotates, the driven plate is moved linearly, which results in the adjustment of the tension of the chain saw.

Another objective of the invention is to provide an adjusting member with an adjusting knob received therein and multiple first teeth formed on a bottom face thereof and a driven disk with multiple second teeth corresponding to the first teeth and securely formed with the driving disk, such that the rotation of the adjusting plate drives the rotation of the driven disk and thus the movement of the driven plate is moved and adjustment to the tension of the chain saw is accomplished.

Other objects, advantages and novel features of the invention will become more apparent from the following detailed description when taken in conjunction with the accompanying drawings.

DETAILED DESCRIPTION OF THE INVENTION

Figure 1:
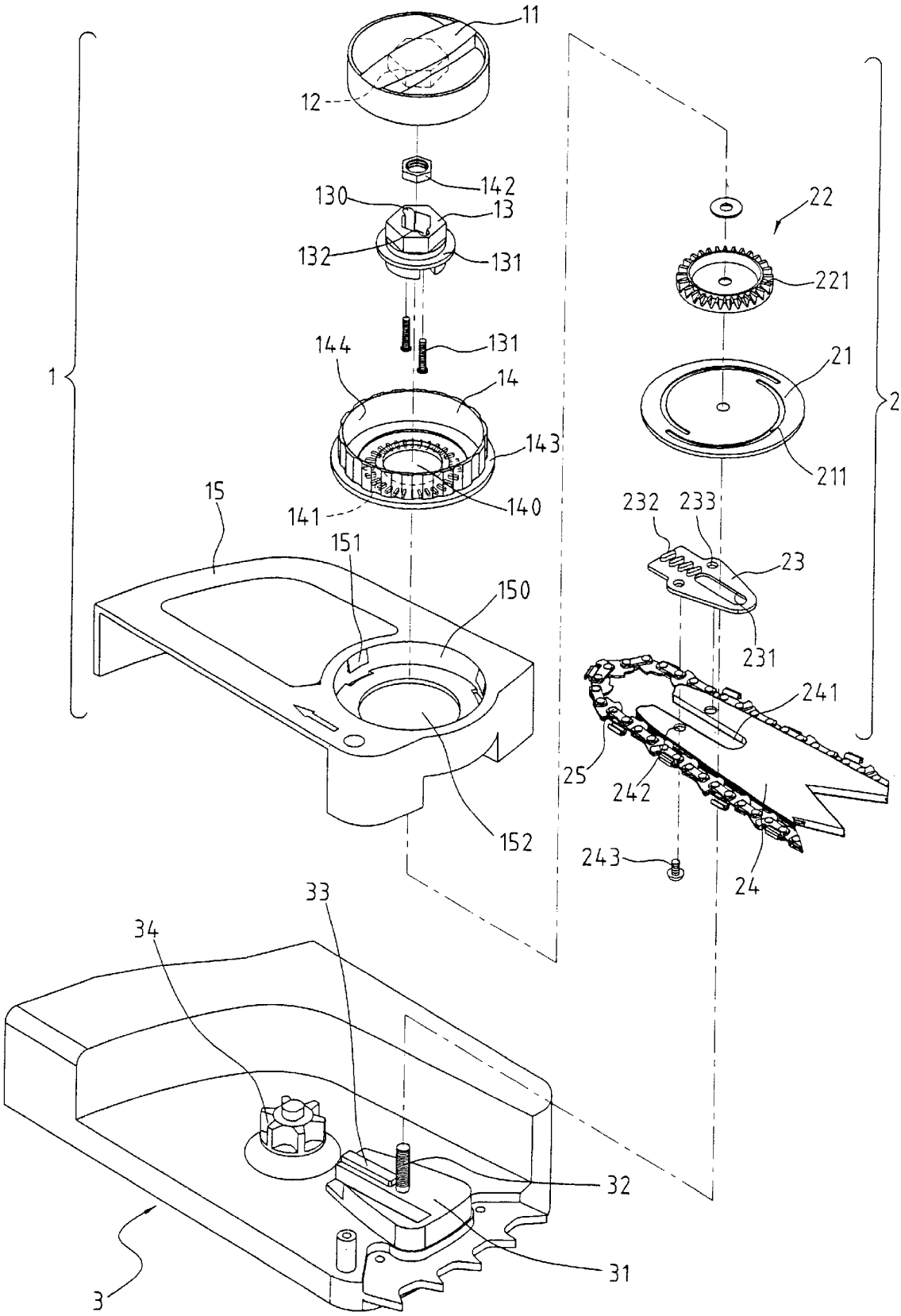
FIG. 1 is an exploded perspective view of the adjusting device for a chain saw.

With reference to FIG. 1, the tension adjusting device in accordance with the present invention has an adjusting assembly 1, a driving assembly 2 and a positioning base 3.

The adjusting assembly 1 has an adjusting knob 11 with a recess 12 defined in a bottom face of the adjusting knob 11, an adjusting member 14 with a central hole 140, multiple first teeth 141 formed on a bottom face of the adjusting member 14, a skirt 143 formed on an outer periphery of the adjusting member 14 and a chamber 144 defined in the adjusting member 14 to communicate with the central hole 140 and a positioning seat 13 corresponding to the recess 12 of the adjusting knob 11 and provided with a through hole 130 corresponding to the central hole 140 of the adjusting member 14 and the recess 12 of the adjusting knob 11, a flange 131 and two cutouts 132 each oppositely defined in a periphery defining the through hole 130 so as to communicate with the through hole 130.

The adjusting knob 11 is selectively and rotatably received in the chamber 144. The positioning seat 13 is so configured that when the positioning seat 13 is received in the recess 12, there is no relative movement between the adjusting knob 11 and the positioning seat 13.

After the positioning seat 13 is received in the recess 12 of the adjusting knob 11, the adjusting knob 11 together with the positioning seat 13 is received in the chamber 144 with the flange 131 engaging the periphery defining the central hole 140. Then, a fastener 131 such as a screw is employed to extend through the central hole 140, the cutouts 132 to threadingly secure the engagement of the positioning seat 13 and the adjusting knob 11. Further, a dust-proof cap 15 is also included in the adjusting assembly 1, wherein the dust-proof cap 15 has a recessed area 150 with multiple wedges 151 formed on a side face of the recessed area 150 and an opening 152 defined in a bottom face defining the recessed area 150 to communicate with the recessed area 150.

The adjusting member 14 is received in the recessed area 150 with the skirt 143 clamped by the wedges 151 so as to secure the adjusting member 14 inside the dust-proof cap 15 yet still allow the adjusting member 14 to rotate inside the recessed area 150. Meanwhile, the through hole 130 communicates the opening 152 and is exposed to the air.

The driving assembly 2 has a driving disk 21 with two diametrically opposite arcuate tracks 211 formed on a bottom face of the driving disk 21, a driven disk 22 with multiple second teeth 221 formed on a top face of the driven disk 22 to correspond to the first teeth, a driven plate 23 having an elongate channel 231, multiple bosses 232 oppositely formed to the elongate channel 231 and two opposite first positioning holes 233 and a guide 24 with a path 241 defined to correspond to the channel 231 and two opposite second positioning holes 242 corresponding to the first positioning holes 233. A chain saw 25 is rotatably mounted on an outer periphery of the guide 24.

The seat 3 has a platform 31, a threaded bolt 32 extending from a top face of the platform 31 to correspond to the path 241 and the channel 231, a guiding plate 33 integrally formed on the platform 31 to correspond to the path 241 and a driving wheel 34 for driving the chain saw 25 to rotate around the guide 24.

Figure 2:
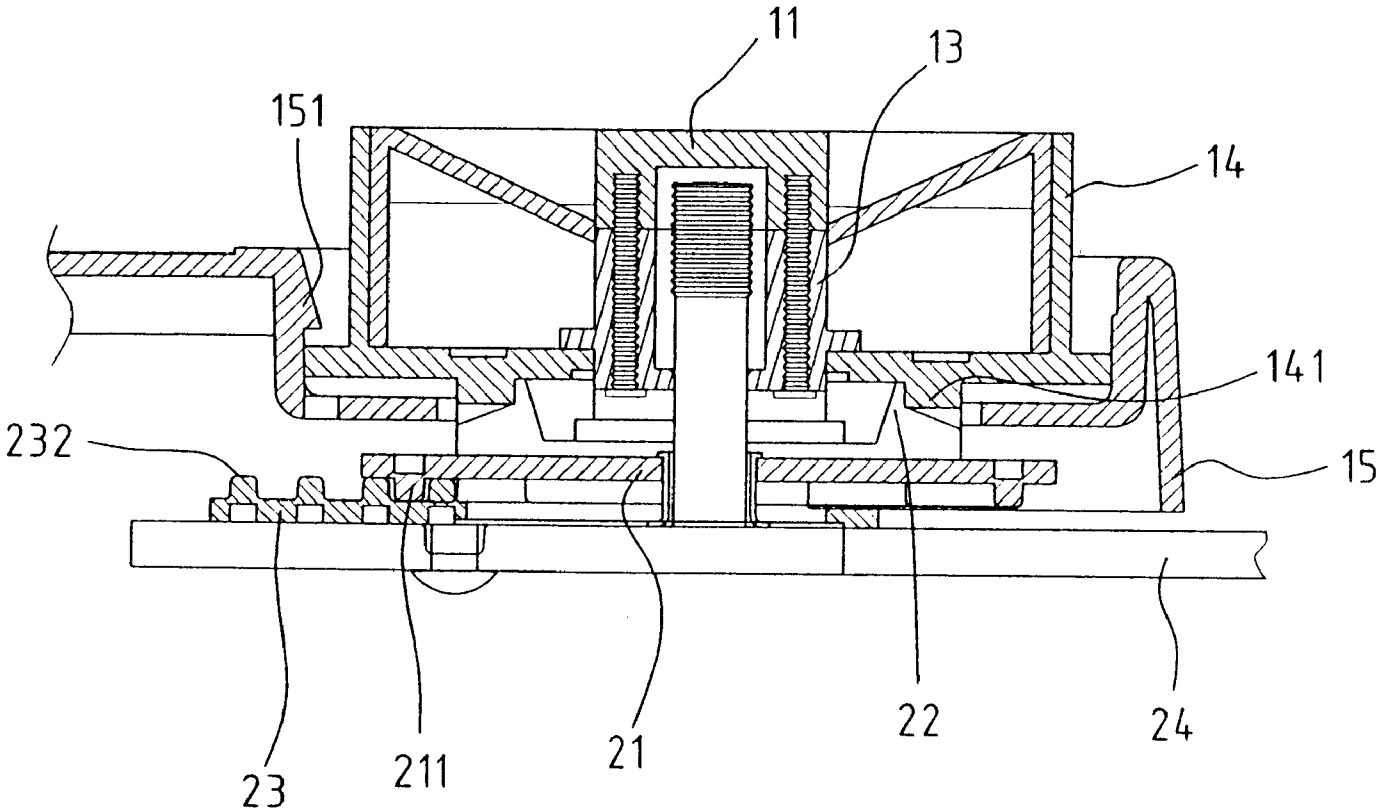
FIG. 2 is a partial cross sectional view of the assembled adjusting device of the present invention.

With reference to FIG. 2, when the adjusting device of the invention is assembled, the driven disk 22 is mounted with the driving disk 21 and the driven plate 23 and the guide 24 are secured with each other by means of screws 243 screwed into aligned second positioning holes 242 and first positioning holes 233. After the assembly between the driving disk 21, the driven disk 22 and the driven plate 23 and the guide 24, the threaded bolt 32 extends through the path 241, the channel 231, the driving disk 21, the driven disk 22, the opening 152, the central hole 140 and a nut 142 that is securely received in the through hole 130 to screw with the adjusting knob 11 and the nut 142 is so configured that there is no relative movement between the nut 142 and the positioning seat 13 after the nut 142 is received in the through hole 130. When the threaded bolt 32 threadingly extends through the nut 142, the guiding plate 33 is received in the path 241 and one of the arcuate tracks 211 is received between two adjacent bosses 232.

Figure 3:
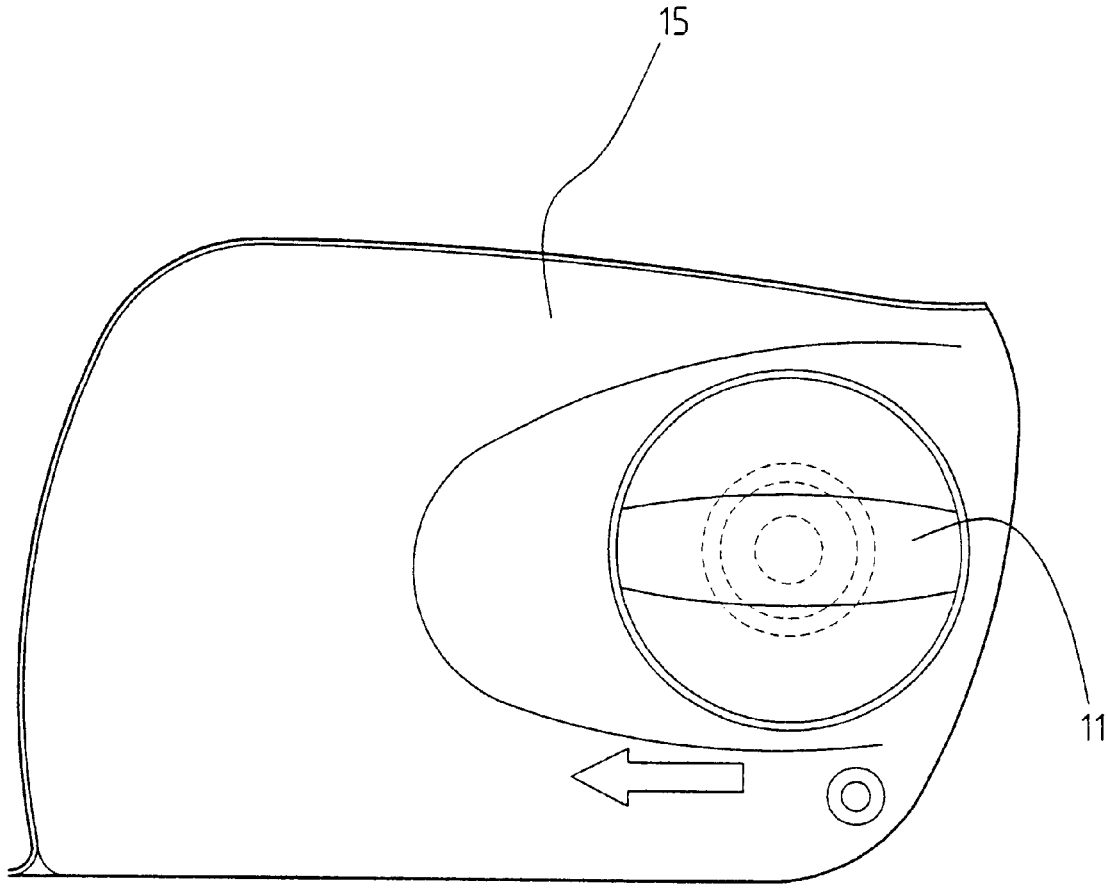
FIG. 3 is a top plan view showing the adjusting of the adjusting knob.
Figure 4A:
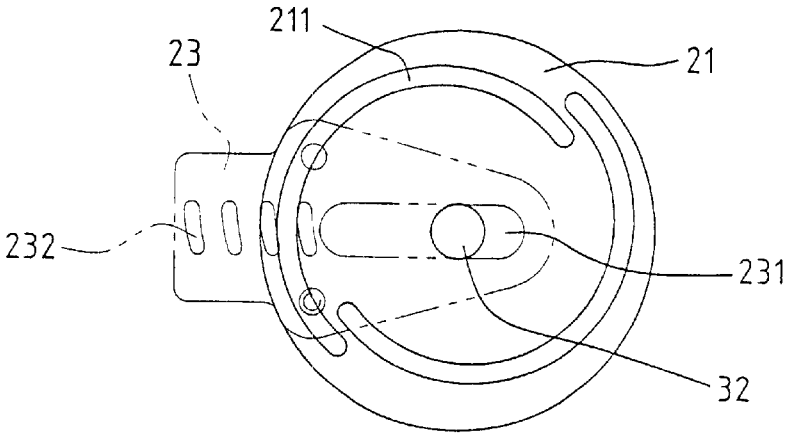
FIGS. 4A to 4F are operational view showing the relative movement between the driving disk and the driven plate.
Figure 4B:
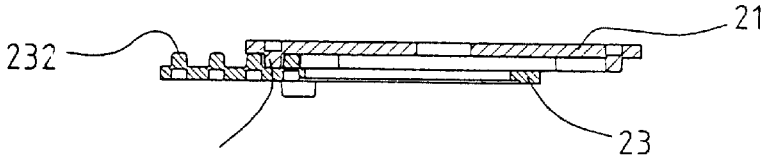
Figure 4C:
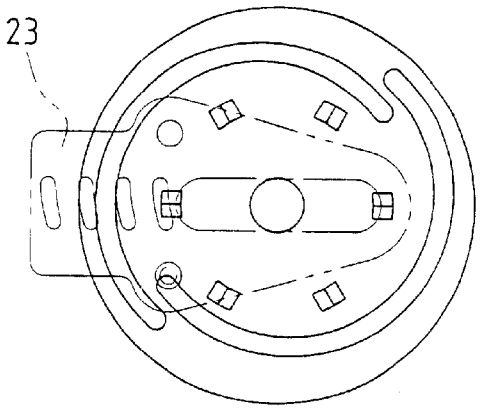
Figure 4D:
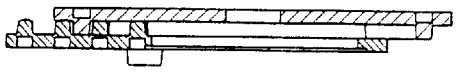
Figure 4E:
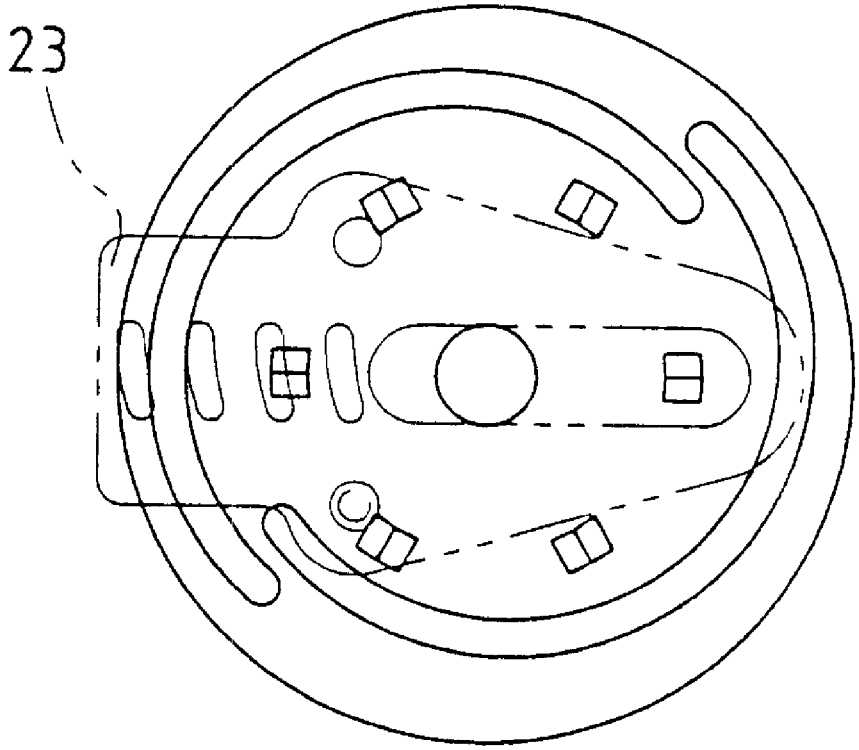
Figure 4F:
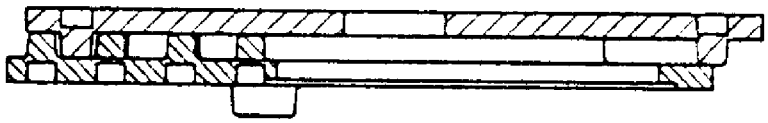
Figure 5:
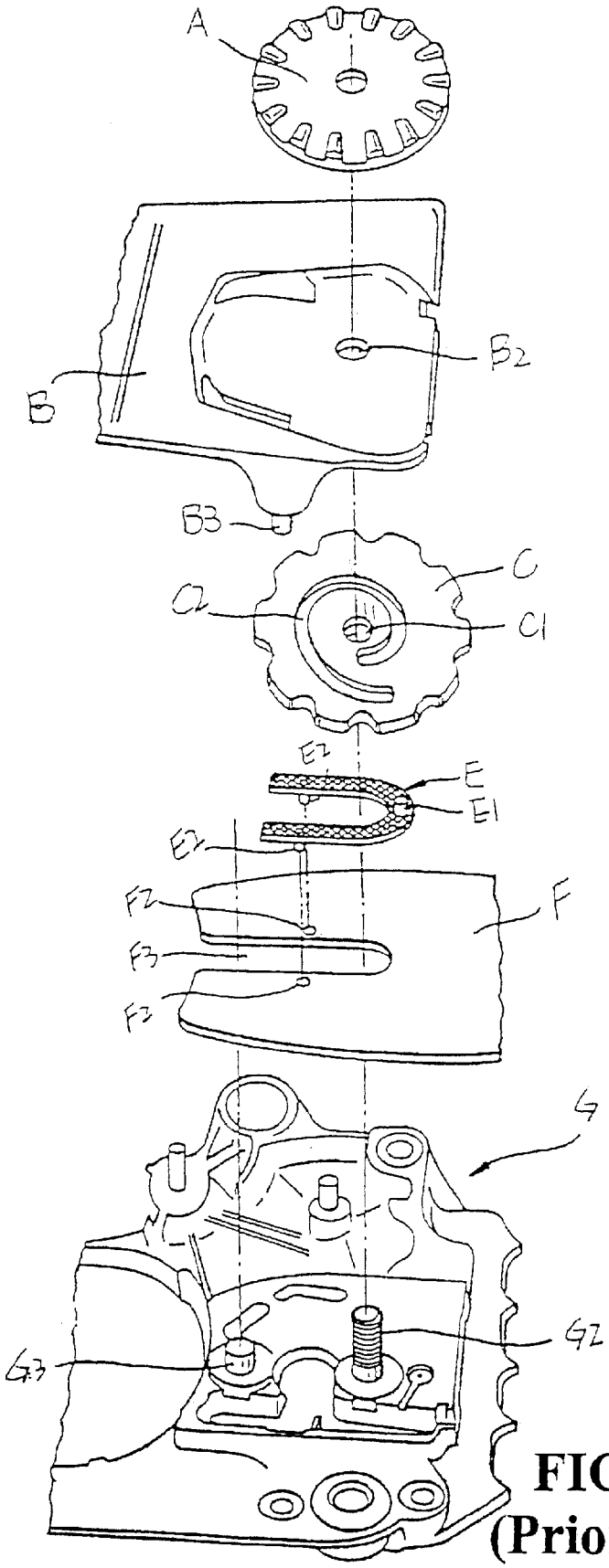
FIG. 5 (Prior Art)
FIG. 5 is an exploded perspective view of a conventional adjusting device.

Thereafter, when an adjustment to the tension of the chain saw is necessary, the user first loosens the adjusting knob 11 to allow the adjusting member 14 to freely rotate with respect to the adjusting knob 11, as shown in FIG. 3. As a result of the rotation of the adjusting member 14, due to the engagement between the first teeth 141 and the second teeth 221, the driven disk 22 is also rotated. Because the driven disk 22 and the driving disk 21 are firmly engaged with each other, the driving disk 21 is rotated, which allows one of the tracks 211 that is received between to adjacent bosses 232 to drive the driven plate 23 linearly. Again, because the driven plate 23 is firmly engaged with the guide 24, the guide 24 is also moved linearly along with the driven plate 23.

With reference to FIGS. 4A to 4F, when the driving disk 21 rotates, the driven plate 23 moves simultaneously and linearly, which moves the guide 24 in a linear direction and thus an adjustment to the tension of the chain saw 25 is accomplished.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjusting device for a chain saw, the adjusting device comprising:

an adjusting assembly having:

an adjusting member with a central hole, multiple first teeth formed on a bottom face of the adjusting member, a skirt formed on an outer periphery of the adjusting member and a chamber defined in the adjusting member to communicate with the central hole;

an adjusting knob selectively and rotatably received in the chamber of the adjusting member and provided with a recess defined in a bottom face of the adjusting knob to communicate with the chamber and the central hole;

a positioning seat securely received in the recess of the adjusting knob and provided with a through hole corresponding to the central hole of the adjusting member and the recess of the adjusting knob, a flange formed to engage with a periphery defining the central hole of the adjusting member;

a dust-proof cap having a recessed area defined to receive therein the adjusting member, the positioning seat and the adjusting knob and provided with an opening defined in a bottom face defining the recessed area to communicate with the recessed area;

wherein the adjusting member is selectively rotatable inside the recessed area with respect to the adjusting knob and the dust-proof cap; a driving assembly having:

a driving disk with two diametrically opposite arcuate tracks formed on a bottom face of the driving disk;

a driven disk firmly engaged with the driving disk and provided with multiple second teeth formed on a top face of the driven disk to correspond to the first teeth;

a driven plate having an elongate channel, multiple bosses oppositely formed to the elongate, wherein one of the arcuate tracks is received between two adjacent bosses; and a guide securely engaged with the driven plate and provided with a path defined to correspond to the channel and being so adapted that the chain saw is rotatably mounted on an outer periphery of the guide; and a seat having a threaded bolt extending outwardly to extend through the path, the channel, the driving disk, the driven disk, the opening of the dust-proof cap, the central hole of the adjusting member, the through hole of the positioning seat and into the recess of the adjusting knob to selectively and threadingly engage with the adjusting knob, a guiding plate integrally formed to correspond to the path so as to be received in the path and a driving wheel for driving the chain saw to rotate around the guide;

whereby the rotation of the adjusting member drives the driven disk to rotate, which allows one of the tracks to move between two adjacent bosses and a linear movement to the driven plate together with the guide is accomplished.

2. The adjusting device as claimed in claim 1, wherein the dust-proof cap has multiple wedges formed on a side face of the recessed area to engage with the skirt of the adjusting member so as that the adjusting member is securely yet rotatable inside the recessed area.

3. The adjusting device as claim 1, the driven plate has two first positioning holes and the guide has two second positioning holes corresponding to the two first positioning holes of the driven plate so that the driven plate is able to securely engage with the guide by fasteners.

4. The adjusting device as claim 2, where in the seat has a guiding plate formed to be received in the path so as to limit the movement of the guide in a linear direction.

* * * * *